United States Patent [19]

Lin

[11] Patent Number: 5,029,347

[45] Date of Patent: Jul. 9, 1991

[54] PNEUMATIC APPARATUS FOR LIFTING AND LOWERING TOILET SEAT

[76] Inventor: Yu Lin, P.O. Box 55-1670, Taipei, Taiwan

[21] Appl. No.: 567,185

[22] Filed: Aug. 14, 1990

[51] Int. Cl.[5] ..... A47K 13/10

[52] U.S. Cl. ..... 4/251; 220/263; 220/264

[58] Field of Search ..... 4/249, 250, 251, 254; 60/903; 248/147; 220/262, 263, 264; 92/44

[56] References Cited

U.S. PATENT DOCUMENTS

| | | | |
|---|---|---|---|
| 2,092,707 | 9/1937 | Zulkoski | 4/251 |
| 2,232,895 | 2/1941 | White | 4/251 |
| 2,842,779 | 7/1958 | Zulkoski | 4/251 |
| 2,849,728 | 9/1958 | Gyllenberg | 4/251 |
| 4,103,371 | 8/1978 | Wilson | 4/251 |
| 4,853,983 | 8/1989 | Grant | 4/251 |

FOREIGN PATENT DOCUMENTS

| | | | |
|---|---|---|---|
| 564460 | 11/1932 | Fed. Rep. of Germany | 4/251 |
| 2171426 | 8/1986 | United Kingdom | 4/251 |

*Primary Examiner*—Henry J. Recla
*Assistant Examiner*—Robert M. Fetsuga

[57] ABSTRACT

A pneumatic apparatus includes a treadle bellows fluidically communicated with a follower bellows of which an upper bellows flange is secured with a toilet seat and a lower bellows flange secured on a toilet bowl, whereby depressing the treadle bellows compresses air into the follower bellows for expanding the follower bellows, the toilet seat and cover will be lifted, and upon a releasing of the treadle bellows the air in the follower bellowers will be sucked into the treadle bellows to contract the follower bellows to lower the seat and the cover for relevant uses.

9 Claims, 3 Drawing Sheets

PNEUMATIC APPARATUS FOR LIFTING AND LOWERING TOILET SEAT

BACKGROUND OF THE INVENTION

F. B. Boston disclosed an automaic toilet seat lifter in his U.S. Pat. No. 2,636,185 which may automatically lift a toilet seat by spring mechanism. However, the toilet seat should be first lowered by a user's hand before sitting on the toilet seat. The user may dislike such an operation since he may suspect the hygienic condition of the toilet seat, whether being contaminated by urine or dirt.

It is therefore needed an apparatus for conveniently lifting and lowering a toilet seat and cover without touching the toilet seat.

Summary of the Invention

The object of the present invention is to provide a pneumatic apparatus including a treadle bellows fluidically communicated with a follower bellows of which an upper bellows flange is secured with a toilet seat and a lower bellows flange secured on a toilet bowl, whereby upon treading of the treadle bellows air is compressed into the follower bellows for expanding the follower bellows and the toilet seat and cover will be lifted, and upon a releasing of the treadle on the treadle bellows, the air in the follower bellows will be sucked into the treadle bellows to contract the follower bellows to lower the seat and the cover for relevant uses.

DETAILED DESCRIPTION

Figure 1:
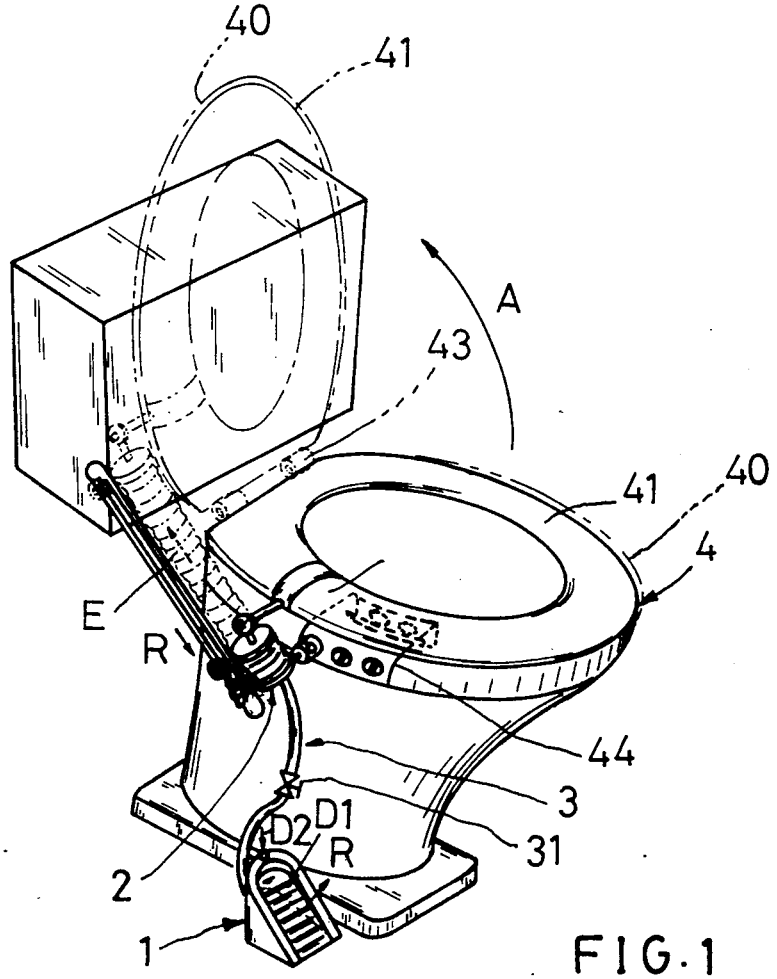
FIG. 1 is a perspective illustration of the present invention.

As shows in the figures, the present invention comprises: a treadling means 1, a lifting and lowering means 2, and a delivery tube 3 connecting the treadling means 1 and the lifting and lowering means 2.

The treadling means 1 is mounted or laid on a lavatory floor and includes: an outer casing 10, a treadle bellows 11 having an upper front edge portion 12 operatively depressing a positioning lock 18 resiliently held in a guide pipe 141, a restoring spring 13 mounted in the bellows 11 for normally expanding the bellows 11 upwardly, a return push-button 14 resiliently held in the guide pipe 141 by a tensioning spring 16 which is jacketed on a button rod 15 secured to the button 14 and rested on a shoulder portion 142 formed in the pipe 141, and a sliding block 17 formed on a lower portion of the rod 15 downwardly depressing the lock 18 for retracting the lock 18.

Figure 4:
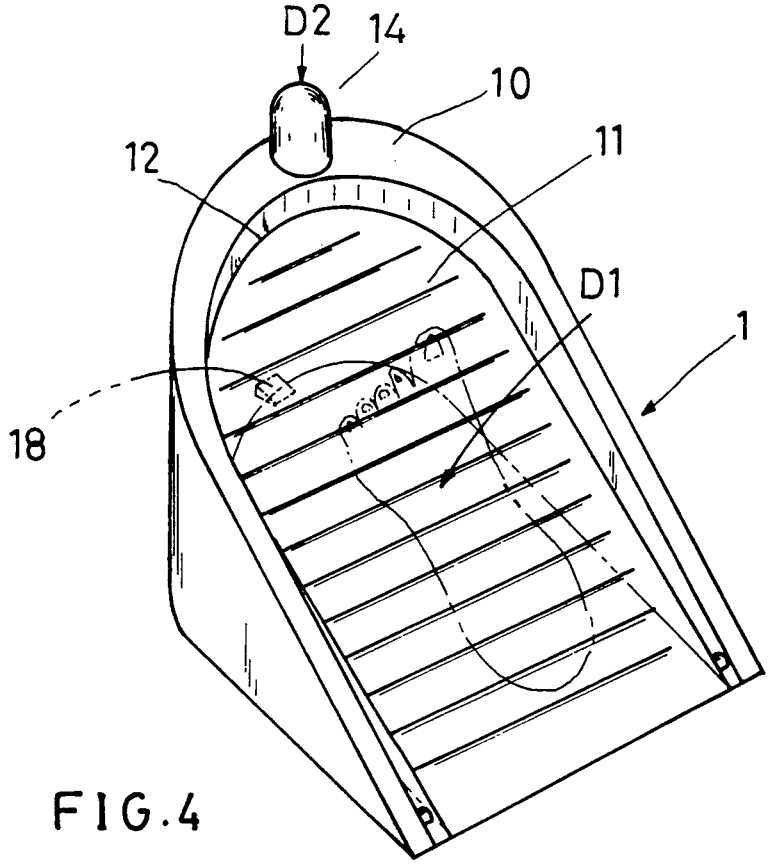
FIG. 4 is a perspective view of the treadling means of the present invention.

The treadle bellows 11 is encased in the casing 10 which may be formed as a U shape as shown in FIG. 4. The guide pipe 141 may also be mounted in the casing 10 for esthetic purpose. Other modifications of bellows 11 and push-button 14 may be made without departing from the scope and spirit of this invention.

The positioning lock 18 is generally formed as a triangular block having an upper slope surface sloping outwardly downwardly and a lower horizontal flat edge intersecting the slop surface and is resiliently held in th pipe 141 by a srping 181. The trianglular block of the lock 18 normally resiliently protrudes outwardly through a side opening 143 formed in the pipe 141 to be depressed by the edge portion 12 of the bellows 11. The sliding block 17 is generally formed with a cylindrical block slidably held in the pipe 141 having a bottom slope surface sloping downwardly outwardly to be tangentially engageable with the upper slope surface of the lock 18. The spring 16 normally urges the push-button 14 upwardly to be depressed by a user's foot.

The lifting and lowering means 2 includes: a follower bellows 21 having a lower flange 22 secured to a lower clip 23 mounted on a toilet bowl 44 of a toilet 4 or other suitable locations in the lavatory, and an upper flange 24 secured to an upper fastener 25 fastened to a seat ring 42 of tie toilet seat 41 pivotally mounted on the bowl 44 by hinge 43; and a reciprocating guide 26 generally formed as an elongate plate secured to the lower flange 22 protruding rearwardly inclinedly. The lower flange may be fixed on any other frame or stand (not shown) near the toilet.

Figure 2:
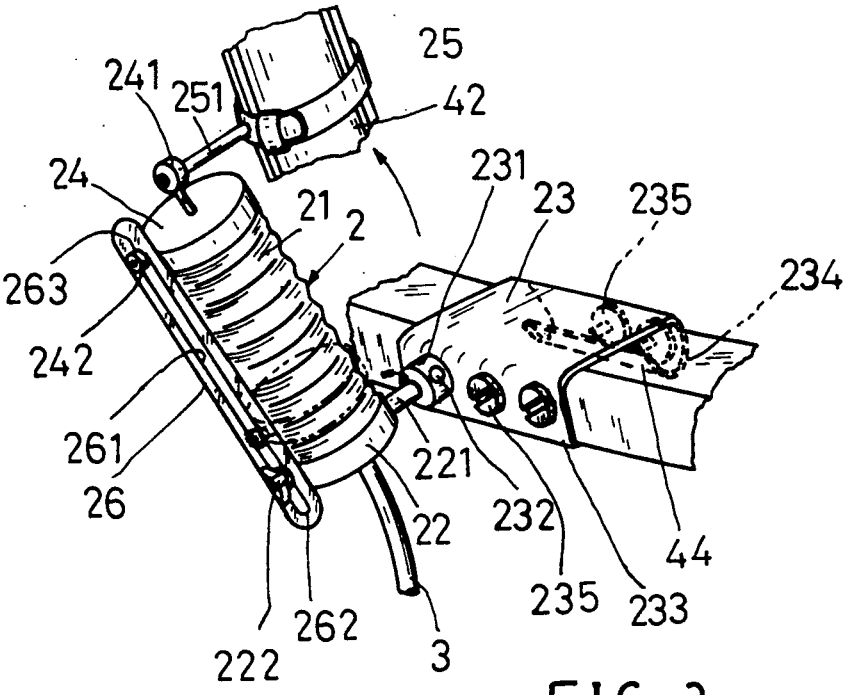
FIG. 2 shows a lifting and lowering means for lifting and lowering a toilet seat and cover of the present invention.
Figure 3:
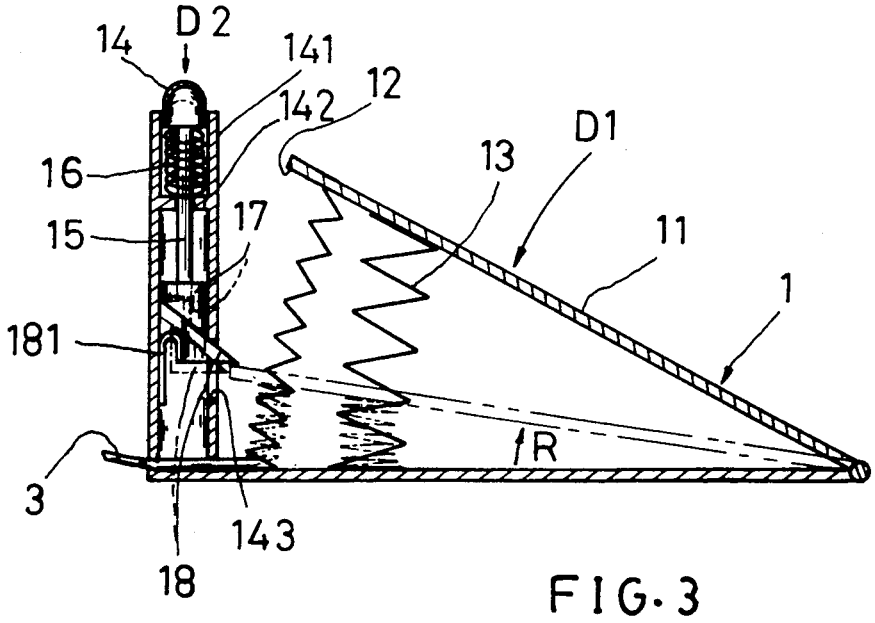
FIG. 3 shows a treadling means of the present invention.

The follower bellows 21 is fluidically communicated with the treadle bellows 11 by delivery tube 3. The lower flange 22 includes an inner bolt 221 fixed in a socket 231 rotatably formed on an outer flap 233 of the lower clip 23 and an outer bolt 222 protruding through a longitudinal slot 261 formed in the elongate guide 26 for firmly mounting the guide 26 by a nut fixed on the bolt 222. The lower clip 23 includes the outer flap 233 and an inner flap 234 to be mounted on the bowl 44 by screws 235. The upper flange 24 is pivotally secured to a pivot rod 251 by a pivotal or universal connector 241, which rod 251 is pertinent to a fastener 25 fastening the seat ring 42. The upper flange 24 has a limiting bolt 242 slidably moving in the slot 261 and is limited by an uppermost end portion 263 of the slot 261. The lower bolt 222 can be adjustably fixed with a lower portion 262 of the slot 261 for adjusting a stroke of the follower bellows 21 in terms of an opening angle A of the lifted toilet seat 41. The guide 26 may also be mounted on other suitable location on the toilet 4 or in the lavatory. The protruding angle of the guide 26 and the follower bellows 21 can be adjusted about a fulcrum at the inner bolt 221 mounted in the socket 231 as shown in FIG. 2. The tilting or opening angle A is preferably be slightly less than 90 degrees so that upon a contraction of the follower bellows 21 to lower the seat 41, the cover 40 gravitationally overlain on the seat 41 will also be lowered. A stopper (not shown) fixed on a back portion of the cover 40 may also help define the acute angle A to be slightly less than 90 degrees.

The guide 26 as shown in FIG. 2 is installed at a distal (outer) side apart from the pivotal bolt 221 for illustrative purpose. However, for more stable assembly of the plate 26 on the lower flange 22, the guide 26 is preferably fixed on an inner side of the bellows 21.

Figure 5:
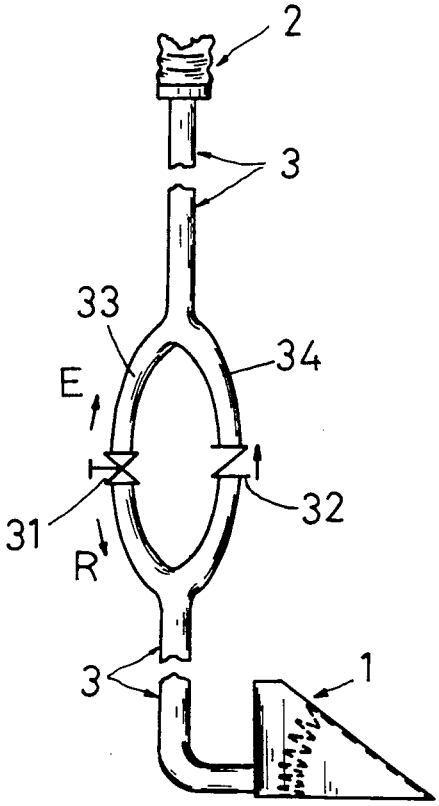
FIG. 5 shows a delivery tube communicating the lifting means and the treadling means of the present invention.

The delivery tube 3 may be a flexible hose or rigid tube connected between the two bellows 11, 12 and includes a regulating valve 31 for adjusting air flow rate for adjusting the speed for lifting and lowering the seat. As shown in FIG. 5, a regulating valve 31 is formed on a first branch tube 33 bifurcated from the tube 3 and a check valve 32 formed in a second branch tube 34 allowing an one-way air flow such as shown in arrow mark to thereby allow a quick lifting operation, but a slower lowering action. The upward movement of seat is limited by the upper portion 263 of the guide 26, whereas the downward movement of seat is dampened for preventing vibration or noise by a slower air return rate by merely passing through the single valve 31.

When a man tends to pass urine into the toilet 4, he will depress the treadle bellows 11 downwardly (D1) to compress air into the follower bellows 21 through the tube 3 to expand the bellows 21 in direction E as shown in FIG. 1 to thereby raise the seat 41 and the cover 40 overlain thereon about the hinges 43 since the upper flange 24 of the bellows 21 is pivotally secured to the seat ring 42. The seat and cover is now lifted and will not be contaminated by urine passed by the user. Upon the treadling of the bellows 11 (D1), the upper front edge portion 12 will be depressed downwardly to be locked by the triangular block of the lock 18.

When anyone wishes to sit down on the seat 41, he or she may depress the push button 14 as shown in arrow mark D2 as shown in FIGS. 4 and 1 to lower the sliding block 17 to tangentially retract the lock 18 so that the edge portion 12 or the bellows 11 will then be unlocked and the restoring spring 13 will restore the bellows 11 upwardly to such air from the follower bellows 21 (direction R) to constringe the follower bellows 21 to lower the seat and cover for seating purpose.

The present invention is superior to a conventional toilet lifter with th following advantages:

1. The lifting and lowering of the toilet seat and cover can be simply done just by depressing the bellows 11 and push button 14 without contacting the seat by a user's hand which is suspected of being contaminated by dirt or urine.

2. The system is a pneumatic one without requiring any electric power. Also the structure an elements forming the present invention are quite simple for minimizing production cost and maintenance problems.

3. This invention can be installed on a new or used seat without influencing the original toilet facilities for easier installation and assembly.

4. The lifting and lowering operation of the toilet seat is dampened or absorbed by the air in the system to be silent to prevent any noise pollution, especially at a silent night or sleeping time.

5. The elements of this invention can be packed into one kit for D-I-Y (Do-it-yourself) purpose, which can be easily assembled by the user, without the aid of a professional plumber.

I claim:

1. A pneumatic apparatus for use with a toilet having a bowl with a rim and a seat and cover pivotally mounted to the rear of the bowl and overlying the rim, said apparatus comprising:

treadle means adapted to be disposed on the floor adjacent the toilet bowl, said treadle means including a treadle bellows which is compressed upon depression of said treadle means;

lifting and lowering means responsive to said treadle means for lifting and lowering said toilet seat and lid, said lifting and lowering means having a lower flange adapted to be secured to the rim of the toilet bowl to one side thereof and an upper flange adapted to be secured to the toilet seat such that said upper and lower flanges are substantially adjacent each other when said seat rests on said rim, said lifting and lowering means including a follower bellows connected between said upper and lower flanges; and, a tube fluidically connecting said treadle bellows and said follower bellows, whereby, depression of said treadle means compresses said treadle bellows to force air into said follower bellows thereby raising the toilet seat.

2. A pneumatic apparatus according to claim 1, wherein said treadle means further includes: an outer casing surrounding said treadle bellows, said treadle bellows having a restoring spring secured therein for normally expanding said treadle bellows upwardly and having an upper front edge portion operatively engageable with a positioning lock movably held in a guide pipe formed in said outer casing a biased return push-button movably disposed in said pipe and having a sliding block formed on a lower portion of a button rod secured to said push-button for operatively retracting said positioning lock for restoring said treadle bellows when depressing said push-button.

3. A pneumatic apparatus according to claim 2, wherein said button rod is coaxial with a tensioning spring disposed in said pipe and normally urging said push-button upwardly, said sliding block having a bottom sloped surface tangentially engageable with an upper sloped surface formed on a triangular block of said positioning lock that is normally biased to protrude outwardly through a side opening formed in said pipe for retracting said lock, said triangular block of said lock having a lower horizontal flat surface to be operatively engaged with said upper front edge portion of said treadle bellows for operatively locking said treadle bellows in the downwardly depressed position.

4. A pneumatic apparatus according to claim 1, wherein said lifting and lowering means further includes a reciprocating guide generally formed as an elongate plate having a longitudinal slot formed therein, said upper flange of said follower bellows having a limiting bolt to engage an uppermost end portion of said slot, said lower flange of said follower bellows having an outer bolt extending through said slot of and adjustably fixed to said reciprocating guide for adjusting a moving stroke of said follower bellows in terms of an opening angle of said toilet seat about said hinge pivotally connecting said seat and cover and said toilet bowl.

5. A pneumatic apparatus according to claim 1, wherein said lower flange of said follower bellows includes an inner bolt secured to a socket formed on a lower clip adapted to be fixed to said rim of said toilet bowl, said follower bellows being adjustably fixed with said lower clip by rotating said inner bolt in said socket of said lower clip.

6. A pneumatic apparatus according to claim 1, wherein said upper flange is pivotally secured between said follower bellows and an upper fastener for fastening to said toilet seat.

7. A pneumatic apparatus according to claim 4, wherein said longitudinal slot of said reciprocating guide limits upward movement of said toilet seat between an angle of an original lowered horizontal position to slightly less that 90 degress.

8. A pneumatic apparatus according to claim 1, wherein said tube connected between said bellows has a regulating valve formed therein for adjusting air flow rate in terms of a lifting or lowering speed of the seat.

9. A pneumatic apparatus according to claim 1, wherein said tube includes a first branch tube having a regulating valve formed therein, and a second branch tube having a check valve formed therein allowing one-way air flow from said treadle bellows to said follower bellows through said second branch tube.

* * * * *